US008998202B2

(12) United States Patent
Kai

(10) Patent No.: US 8,998,202 B2
(45) Date of Patent: Apr. 7, 2015

(54) IMAGE FORMING APPARATUS AND SHEET RECONVEYANCE PROPRIETY DISCRIMINATING METHOD

(71) Applicant: Canon Kabushiki Kaisha, Tokyo (JP)

(72) Inventor: Teruhito Kai, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/874,261

(22) Filed: Apr. 30, 2013

(65) Prior Publication Data

US 2013/0300056 A1 Nov. 14, 2013

(30) Foreign Application Priority Data

May 8, 2012 (JP) ..... 2012-106893

(51) Int. Cl.

| | |
|---|---|
| ***B65H 7/02*** | (2006.01) |
| ***B65H 7/12*** | (2006.01) |
| ***B65H 5/06*** | (2006.01) |
| ***B65H 7/06*** | (2006.01) |
| ***G03G 15/00*** | (2006.01) |

(52) U.S. Cl.

CPC ..... *B65H 7/125* (2013.01); *B65H 5/062* (2013.01); *B65H 7/06* (2013.01); *G03G 15/602* (2013.01); *B65H 2511/414* (2013.01); *B65H 2511/528* (2013.01); *B65H 2513/511* (2013.01); *B65H 2515/82* (2013.01)

(58) Field of Classification Search

USPC ..... 271/259, 258.01, 265.01, 265.02

See application file for complete search history.

(56) References Cited

U.S. PATENT DOCUMENTS

| | | | | |
|---|---|---|---|---|
| 5,945,602 | A * | 8/1999 | Ross | 73/570 |
| 8,783,684 | B2 * | 7/2014 | Hongo et al. | 271/259 |

FOREIGN PATENT DOCUMENTS

| | | | |
|---|---|---|---|
| JP | 11-116098 | A | 4/1999 |
| JP | 2002-154744 | A | 5/2002 |
| JP | 2009-249046 | A | 10/2009 |
| JP | 2010-276930 | A | 12/2010 |

* cited by examiner

*Primary Examiner* — Michael McCullough
*Assistant Examiner* — Howard Sanders
(74) *Attorney, Agent, or Firm* — Canon USA, Inc. IP Division

(57) ABSTRACT

Provided is a technology capable of identifying presence/absence of buckling at an occurrence of a jam and determining more appropriately whether or not to perform automatic sheet discharge. A sound collecting device provided on a conveying path of an image forming apparatus is used to collect sound generated from a sheet at the occurrence of the jam. Generated spectrum data is obtained by analyzing characteristics of the collected sound. The generated spectrum data is compared with reference spectrum data, to thereby identify the presence/absence of the buckling and discriminate the conveyance propriety of the sheet.

9 Claims, 14 Drawing Sheets

1101 1102

| FREQUENCY | INTENSITY OF FREQUENCY COMPONENT |
|---|---|
| 100 | 10 |
| 200 | 10 |
| 300 | 20 |
| 400 | 88 |
| 500 | 5 |
| 600 | 0 |
| | |
| 1000 | 45 |
| | |
| 1500 | 22 |
| | |
| 2100 | 4 |
| | |
| 2400 | 23 |
| | |
| 2900 | 61 |
| | |
| 3500 | 5 |
| | |
| 3800 | 21 |
| | |
| 4300 | 28 |
| | |
| 4500 | 40 |
| 4600 | 10 |
| 4700 | 40 |
| 4800 | 35 |
| 4900 | 30 |
| 5000 | 0 |

FIG. 11A 1103 1104 1105

| | FREQUENCY | LOWER LIMIT VALUE OF INTENSITY | UPPER LIMIT VALUE OF INTENSITY |
|---|---|---|---|
| A | 400 | 60 | 100 |
| B | 1000 | 10 | 50 |
| C | 1500 | 5 | 30 |
| D | 2100 | 8 | 20 |
| E | 2400 | 5 | 25 |
| F | 2900 | 25 | 90 |
| G | 3500 | 10 | 50 |
| H | 3800 | 6 | 25 |
| I | 4300 | 10 | 50 |
| J | 4700 | 15 | 60 |

FIG. 11B 1106 1107

| FIT COUNT | MATCHING RATIO [%] |
|---|---|
| 8 | 80 |

FIG. 11C 1301 1302

| FREQUENCY | INTENSITY OF FREQUENCY COMPONENT |
|---|---|
| 100 | 10 |
| 200 | 10 |
| 300 | 20 |
| 400 | 90 |
| 500 | 5 |
| 600 | 0 |
| | |
| 1000 | 58 |
| | |
| 1500 | 22 |
| | |
| 2100 | 30 |
| | |
| 2400 | 60 |
| | |
| 2900 | 15 |
| | |
| 3500 | 20 |
| | |
| 3800 | 21 |
| | |
| 4300 | 5 |
| | |
| 4500 | 20 |
| 4600 | 10 |
| 4700 | 5 |
| 4800 | 5 |
| 4900 | 5 |
| 5000 | 10 |

FIG. 13A 1303 1304 1305

| | FREQUENCY | LOWER LIMIT VALUE OF INTENSITY | UPPER LIMIT VALUE OF INTENSITY |
|---|---|---|---|
| A | 400 | 60 | 100 |
| B | 1000 | 10 | 50 |
| C | 1500 | 5 | 30 |
| D | 2100 | 0 | 20 |
| E | 2400 | 5 | 25 |
| F | 2900 | 25 | 90 |
| G | 3500 | 10 | 50 |
| H | 3800 | 5 | 25 |
| I | 4300 | 10 | 50 |
| J | 4700 | 15 | 60 |

FIG. 13B 1306 1307

| FIT COUNT | MATCHING RATIO [%] |
|---|---|
| 4 | 40 |

FIG. 13C

IMAGE FORMING APPARATUS AND SHEET RECONVEYANCE PROPRIETY DISCRIMINATING METHOD

BACKGROUND OF THE INVENTION

1. Field of the Invention

The present invention relates to a technology for discriminating conveyance propriety of a sheet used in an image forming apparatus when a clogging (hereinafter referred to as "jam") of the sheet occurs.

2. Description of the Related Art

In an image forming apparatus, a jam of a sheet may occur due to a slip of conveying rollers or the like. In such a case, the sheet is to be removed manually, with the result that an excessive workload is imposed on a user. Further, even if the sheet is manually removed by the user, the jam may occur again due to a remaining piece of paper or the like. Therefore, there is proposed an image forming apparatus having an automatic sheet discharging function for discharging, at an occurrence of a jam, the sheet of which the jam has occurred automatically out of the image forming apparatus. Such an image forming apparatus is useful from the viewpoint of lightening the workload on the user. However, it may be impossible to perform automatic sheet discharging depending on a pattern of the jam of the sheet that has occurred. For that reason, it is necessary to determine in advance whether or not to perform the automatic sheet discharging.

Therefore, in the image forming apparatus disclosed in Japanese Patent Application Laid-Open No. 2010-276930, based on a position on a conveying path of a sheet and a type of jam such as a delay jam or a retention jam, it is determined whether or not to perform automatic sheet discharging. Further, in order to grasp whether or not the subsequent sheet has bumped into the sheet of which the jam has occurred, the position of the subsequent sheet is verified by using a sensor.

In the image forming apparatus disclosed in Japanese Patent Application Laid-Open No. 2002-154744, by dividing a conveying path provided with a flapper for a sheet into three segments, it is determined whether or not to perform automatic sheet discharging. Specifically, the conveying path is divided into a first segment in which the sheet of which a jam has occurred is located positively before the flapper, a second segment in which the sheet has already passed through the flapper positively, and a third segment in which the sheet is passing through the flapper. Then, based on which segment the sheet of which the jam has occurred remains in when the jam occurs, it is determined whether or not to perform the automatic sheet discharging.

However, in the image forming apparatus disclosed in Japanese Patent Application Laid-Open No. 2010-276930, when the subsequent sheet is detected by the sensor, it is determined that the automatic sheet discharging cannot be performed regardless of presence/absence of buckling thereof. In other words, an occurrence of the buckling cannot be detected, and hence the sheet that can originally be subjected to the automatic sheet discharging may fail to be automatically delivered. Further, similarly in the image forming apparatus disclosed in Japanese Patent Application Laid-Open No. 2002-154744, the position of the sheet can be detected at the occurrence of the jam, while the presence/absence of the buckling cannot be detected, and hence the sheet that can originally be subjected to the automatic sheet discharging may fail to be automatically discharged.

Therefore, present invention provides means to grasp a state of a sheet including presence/absence of buckling at an occurrence of a jam and determine more appropriately whether or not to perform automatic sheet discharging. The present invention also provides means to increase the frequency of executing the automatic sheet discharging, to thereby further lighten the load on the user at the occurrence of the jam.

SUMMARY OF THE INVENTION

An image forming apparatus according to an exemplary embodiment of the present invention includes a conveyance unit for conveying a sheet along a conveying path, a microphone for collecting sound generated from the conveyed sheet, a detecting unit for detecting a jam of the conveyed sheet, a control unit for controlling to stop conveying sheet by the conveyance unit if the jam of the sheet is detected by the detecting unit, an analysis unit for analyzing a frequency of the sound during a period in which the sheet is being conveyed if the jam of the sheet is detected, and a decision unit for deciding whether or not the conveyance unit is enabled to discharge the sheet based on the analyzed frequency.

Further, a reconveyance propriety discriminating method according to an exemplary embodiment of the present invention is executed by an image forming apparatus including a mechanism for stopping a sheet of which a jam has occurred on a conveying path and then reconveying the sheet. This method includes collecting sound generated from the sheet and generating quantification data obtained by quantifying a state of the sheet by analyzing characteristics of the collected sound. Further, this method includes discriminating conveyance propriety of the sheet of which the jam has occurred by comparing the quantification data with a discrimination condition for discriminating presence/absence of an abnormality including buckling of the sheet.

According to the exemplary embodiments of the present invention, by analyzing the sound generated from the sheet at the occurrence of the jam, it is possible to grasp the state of the sheet and determine more appropriately whether or not to perform automatic sheet discharging. As a result, it is possible to increase the frequency of executing the automatic sheet discharging, to thereby lighten a workload on a user at the occurrence of the jam.

Further features of the present invention will become apparent from the following description of exemplary embodiments (with reference to the attached drawings).

BRIEF DESCRIPTION OF THE DRAWINGS

FIG. 11A is a diagram exemplifying generated spectrum data.

FIG. 11B is a diagram exemplifying reference spectrum data.

FIG. 11C is a diagram exemplifying data indicating a degree of fitness.

FIG. 13A is a diagram exemplifying the generated spectrum data.

FIG. 13B is a diagram exemplifying the reference spectrum data.

FIG. 13C is a diagram exemplifying data indicating the degree of fitness.

DESCRIPTION OF THE EMBODIMENTS

First Embodiment

Figure 1:
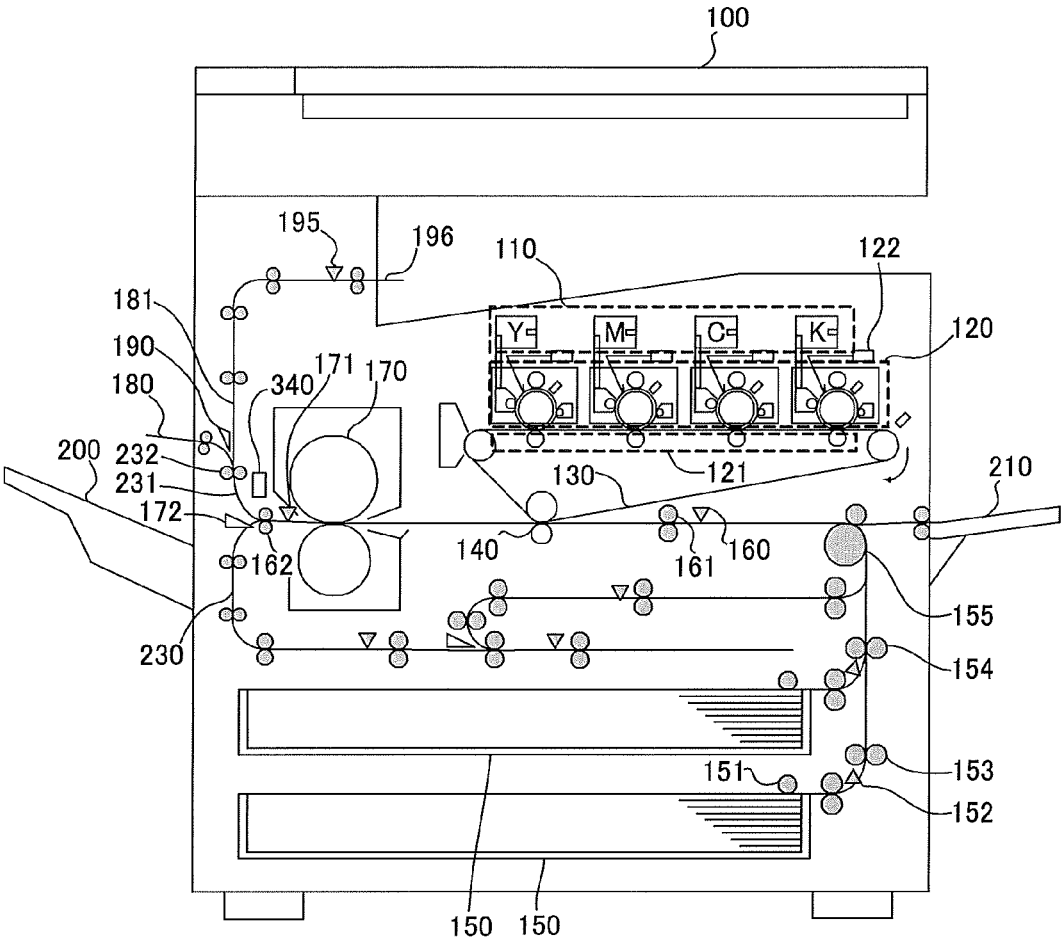
FIG. 1 is a sectional view of an image forming apparatus.

FIG. 1 is a sectional view of an image forming apparatus according to a first embodiment of the present invention. First, basic configurations and operations of the image forming apparatus are described.

(Image Formation)

In the image forming apparatus, a laser scanner unit 122 irradiates a process unit 120 with laser light corresponding to an image read by a reader 100. The process unit 120 includes four photosensitive drums, four developing devices, four charging rollers, and four photosensitive drum cleaners, and forms the image corresponding to the laser light. In other words, after a surface of the photosensitive drum is charged, a latent image is formed on the photosensitive drum by the laser light. The formed latent image is developed onto the photosensitive drums by using developers (toner) of four colors (yellow (Y), magenta (M), cyan (C), and black (K)) within a developer unit 110. Toner image is thus formed. The toner image is transferred onto an image transferring belt 130 by application of a primary transfer voltage thereto in a primary transfer portion 121. The toner image transferred onto the image transferring belt 130 reaches a secondary transfer portion 140 by rotation of the image transferring belt 130.

At a suitable timing in image formation described above, a sheet is fed from a sheet feeding cassette 150 to conveying rollers 153 by a pick-up roller 151. A sheet-feeding pick-up sensor 152 senses that the sheet has been fed in actuality. The sheet is fed to the secondary transfer portion 140 via the conveying rollers 153, conveying rollers 154, conveying rollers 155, and registration rollers 161. A registration sensor 160 is a sensor for sensing the sheet being conveyed. Note that, the sheet may be fed from another sheet feeding cassette 210 to the secondary transfer portion 140 via the registration rollers 161.

The secondary transfer portion 140 transfers the image that has been transferred onto the image transferring belt 130 onto the sheet. The sheet is heated to have the image fixed thereto by a fixing device 170. When a leading edge of the sheet obtained after fixing is sensed by a sheet conveyance sensor 171, the sheet that has passed through conveying rollers 162 has existence thereof confirmed by the sheet conveyance sensor 171, and is then conveyed to any one of a conveying path 230 and a conveying path 231 by a conveyance flapper 172. In a case of double-sided printing, the sheet is conveyed to the conveying path 230, and again conveyed to the secondary transfer portion 140 via the registration rollers 161 with a front surface and a back surface of the sheet reversed.

On the other hand, in a case of one-sided printing or the back surface of the double-sided printing, the sheet is conveyed to the conveying path 231. The sheet that has been conveyed to the conveying path 231 is further conveyed downstream by conveying rollers 232. Here, in the same manner as switching described above, the sheet is conveyed to a conveying path 180 or a conveying path 181 by a conveyance flapper 190. In a case where the sheet is to be delivered to a discharge tray 200, the sheet is conveyed to the conveying path 180. In a case where the sheet is to be delivered to a discharge tray 196, the sheet is conveyed to the conveying path 181. A sheet conveyance sensor 195 is a sensor for sensing the sheet to be delivered from the discharge tray 196.

In the vicinity of the conveying rollers 162, a sound collecting device 340 is disposed. The sound collecting device 340 collects and digitizes sound generated when the sheet is being conveyed, and outputs the resultant as sound data. Note that, a location position of the sound collecting device 340 within FIG. 1 is merely an example, and may be another position in which a jam is likely to occur.

(Functional Blocks)

Figure 2:
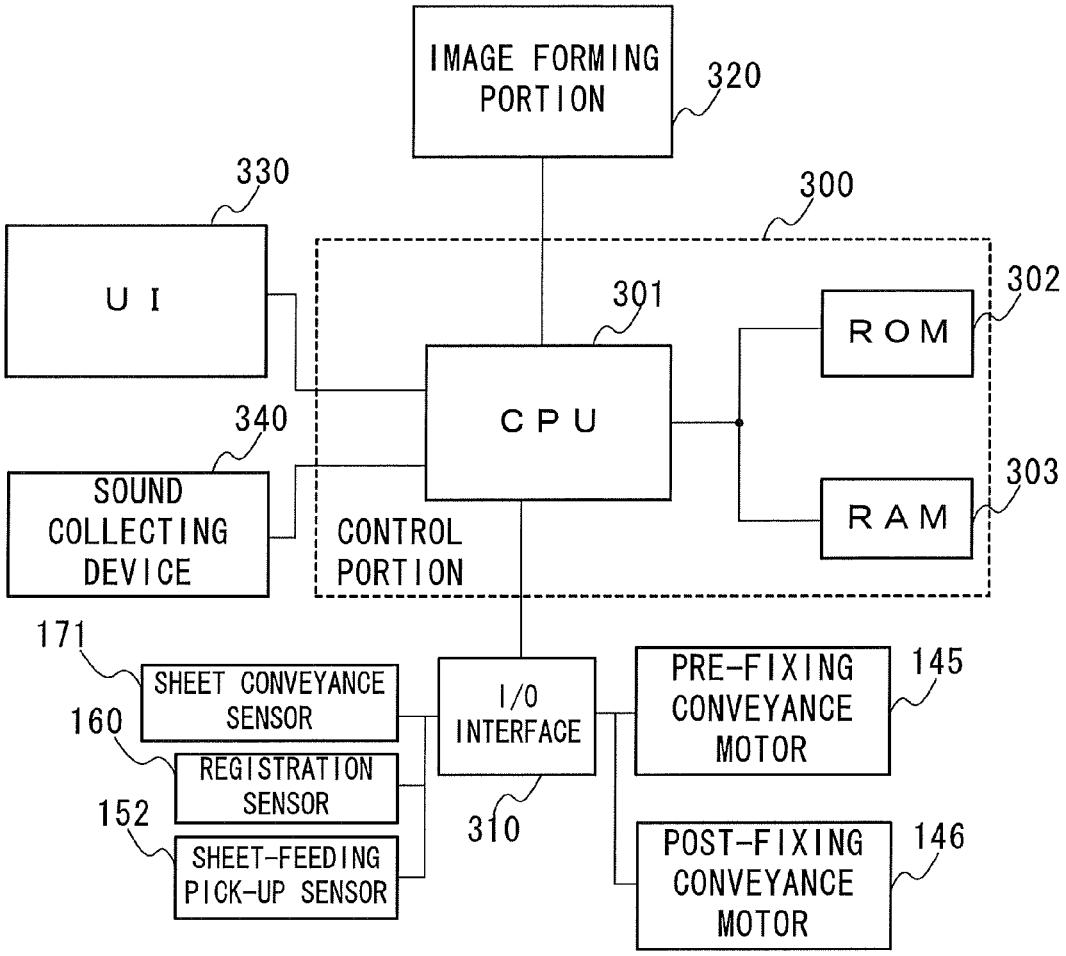
FIG. 2 is a functional block diagram of the image forming apparatus.

FIG. 2 illustrates functional blocks of the image forming apparatus according to this embodiment. An image forming portion 320 is a part of the configuration illustrated in FIG. 1 that excludes a conveyance system. In other words, the process unit 120, the laser scanner unit 122, the developer unit 110, the primary transfer portion 121, the image transferring belt 130, the secondary transfer portion 140, the fixing device 170, and the like correspond to the image forming portion 320. The image forming portion 320 has an operation thereof controlled by a control portion 300.

The control portion 300 includes a central processing unit (CPU) 301, a read only memory (ROM) 302, and a random access memory (RAM) 303. The ROM 302 stores control programs for performing the image formation, characteristic sheet delivery processing, and the like along with reference spectrum data and various parameters that are described later. The RAM 303 forms a work area for the CPU 301. The CPU 301 senses a jam based on the control programs and the parameter that are stored in the ROM 302 and sensed information obtained from various sensors.

The various sensors include the sheet-feeding pick-up sensor 152, the registration sensor 160, the sheet conveyance sensor 171, and the like from which information is input via an input/output (I/O) interface 310.

The control portion 300 (CPU 301) is connected to the sound collecting device 340 and a user interface (UI) 330 for providing the user with an operation environment, for example, an input environment for an instruction to start an operation or the like. Further, the control portion 300 (CPU 301) is connected to a pre-fixing conveyance motor 145 and a post-fixing conveyance motor 146 for driving the conveyance system via the I/O interface 310.

The pre-fixing conveyance motor 145 is a motor for driving conveyance-system rollers for a pre-fixing sheet such as the pick-up roller 151, the registration rollers 161, the conveying rollers 153, the conveying rollers 154, and the conveying rollers 155 that are illustrated in FIG. 1. The post-fixing conveyance motor 146 is a motor for driving conveyance-system rollers for a post-fixing sheet such as the conveying rollers 162 and the conveying rollers 232.

The operation performed by the control portion 300 at a time of the image formation is as follows.

That is, when an instruction to start an printing operation is input from the UI 330 or an external apparatus, the control portion 300 causes the image forming portion 320 to form an image. Further, the control portion 300 causes the image forming portion 320 to start a sheet feeding operation for feeding the sheet from the sheet feeding cassette 150. Specifically, the control portion 300 causes the image forming portion 320 to drive the pre-fixing conveyance motor 145 and to drive the pick-up roller 151. With this operation, the sheets within the sheet feeding cassette 150 are fed to a conveying path sheet by sheet. At this time, the control portion 300 monitors whether or not the sheet has been fed successfully based on a sensing signal obtained from the sheet-feeding pick-up sensor 152.

When the leading edge of the sheet is sensed by the registration sensor 160, the control portion 300 controls a driving timing for the registration rollers 161 so that the leading edge of the sheet and the leading edge of the toner image on the image transferring belt 130 coincide with each other in the secondary transfer portion 140. For example, in a case where the sheet is to reach relatively earlier than the toner image, the sheet is temporarily stopped at the registration rollers 161, and then the conveyance is started again. After timing adjustment is thus performed, the toner image is transferred onto the sheet by application of a secondary transfer voltage thereto in the secondary transfer portion 140.

The sheet onto which the toner image has been transferred is fixed thereto by the fixing device 170, and is then conveyed to a downstream part of the image forming apparatus. When it is sensed that the leading edge of the sheet obtained after the fixing has reached the sheet conveyance sensor 171, the control portion 300 controls the conveyance flapper 172 to switch a destination of conveyance of the sheet according to an instruction specified by the UI 330 or the like in advance. In a case of an instruction for the double-sided printing, the sheet is conveyed to the conveying path 230. In the case of the one-sided printing or the back surface for the double-sided printing, the sheet is conveyed to the conveying path 231. After being conveyed to each of the conveying paths 230 and 231, the sheet moves as described above.

Note that, a control operation performed in the above-mentioned basic image formation is merely an example, and the present invention is not limited to the above-mentioned example of the control operation.

(Example of Control Performed at Time of Jam Sensing)

Next, an example of control performed by the image forming apparatus (control portion 300) at a time of jam sensing is described.

FIGS. 3A, 3B, 4A, and 4B illustrate examples of states of the sheet in a case where the jam has occurred at the time of the image formation.

Figure 3A:
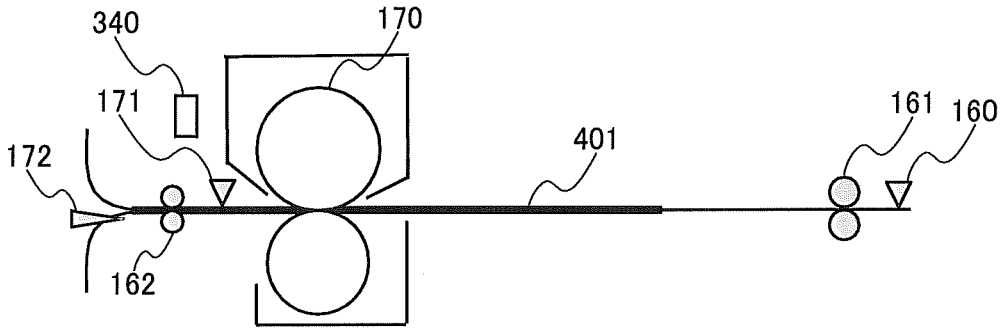
FIG. 3A is a diagram illustrating states of a sheet at an occurrence of a retention jam in a case where there is no buckling.
Figure 3B:
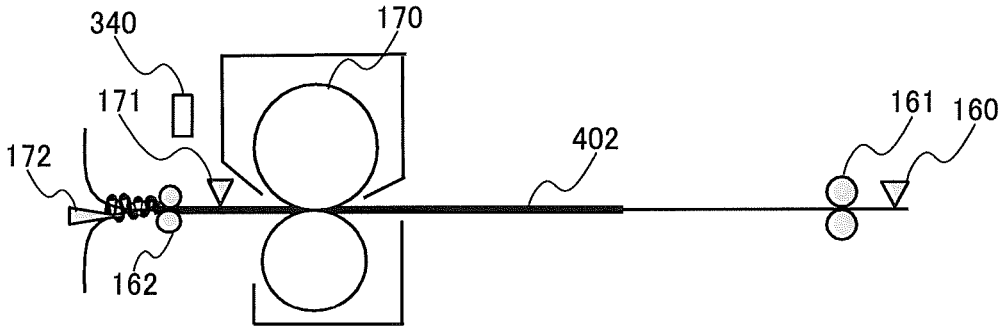
FIG. 3B is a diagram illustrating states of the sheet at the occurrence of the retention jam in a case where the buckling has occurred.

FIGS. 3A and 3B are examples of a retention jam. The sheet passes through the registration sensor 160, the registration rollers 161, and the fixing device 170 to reach the sheet conveyance sensor 171. The retention jam occurs, for example, due to a slip of the sheet in the fixing device 170 or the conveying rollers 162. The CPU 301 determines the retention jam if the sheet conveyance sensor 171 cannot detect a trailing edge of a sheet 401 at a prescribed timing. If the conveyance of the sheet is stopped before the leading edge of the sheet collides with the conveyance flapper 172, jamming paper is not buckled. FIG. 3A illustrates the state in which the jamming paper is not buckled.

FIG. 3B illustrates an example of the state in which buckling has occurred. In a case where the conveyance flapper 172 does not operate normally, the conveyance flapper 172 blocks the path in a conveying direction, and hence the leading edge of a sheet 402 collides with the conveyance flapper 172, which buckles the sheet 402. The CPU 301 determines the retention jam if the sheet conveyance sensor 171 cannot detect the trailing edge of the sheet 402 at the prescribed timing. FIG. 3B illustrates the state in which the buckling has occurred in the leading edge of the jamming paper.

As described above, when it is determined that the retention jam has occurred, there are the state in which the sheet is not buckled (FIG. 3A) and the state in which the sheet is buckled (FIG. 3B). However, the CPU 301 cannot discriminate whether or not the sheet is buckled only based on the detection result from the sheet conveyance sensor 171.

Figure 4A:
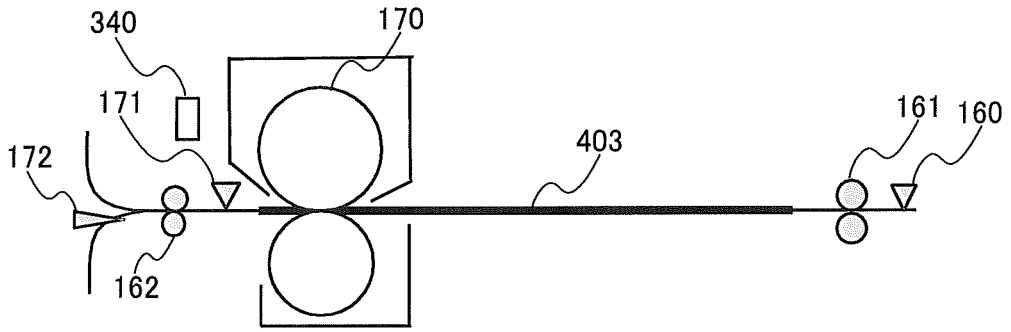
FIG. 4A is a diagram illustrating states of the sheet at an occurrence of a delay jam in the case where there is no buckling.
Figure 4B:
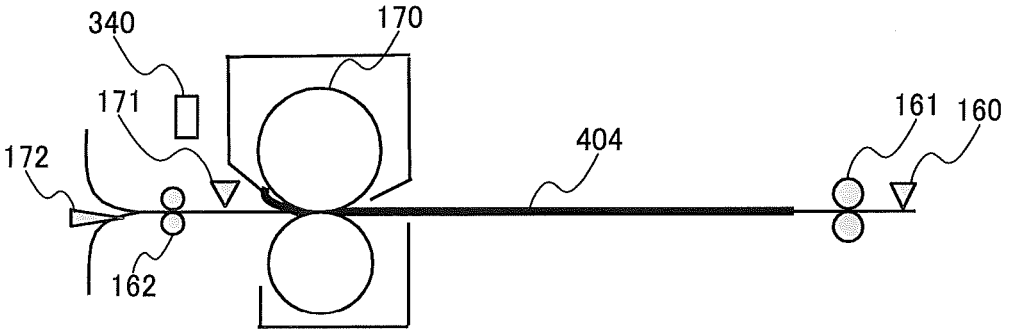
FIG. 4B is a diagram illustrating states of the sheet at the occurrence of the delay jam in the case where the buckling has occurred.

FIGS. 4A and 4B are examples of a delay jam. A course of the conveyance of the sheet is the same as in FIGS. 3A and 3B. The delay jam occurs due to a slip at the time of the conveyance performed by the registration rollers 161 or the fixing device 170. The CPU 301 determines the delay jam if the sheet conveyance sensor 171 cannot detect the leading edge of a sheet 403 even at the prescribed timing. Note that, if the conveyance of the sheet is stopped before the sheet comes into contact with a guide provided on a downstream side of the fixing device 170, the jamming paper is not buckled. FIG. 4A illustrates the state in which the jamming paper is not buckled.

FIG. 4B illustrates an example of the state in which buckling has occurred. In a case where the sheet 404 curls after the leading edge of a sheet 404 has passed through the fixing device 170, the leading edge of the sheet 404 comes into contact with the guide on the downstream side of the fixing device 170, which buckles the sheet 404. The CPU 301 determines the delay jam if the sheet conveyance sensor 171 cannot detect the leading edge of the sheet 404 even when the prescribed timing is reached. At this time, the leading edge of the sheet 404 comes into contact with the guide on the downstream side of the fixing device 170 to stop in the state of being buckled.

As described above, when it is determined that the delay jam has occurred, there are the state in which the sheet is not buckled (FIG. 4A) and the state in which the sheet is buckled (FIG. 4B). However, the CPU 301 cannot discriminate whether or not the jamming paper is buckled only based on the detection result from the sheet conveyance sensor 171.

Therefore, in this embodiment, the following characteristic jam sensing method is employed.

Figure 5A:
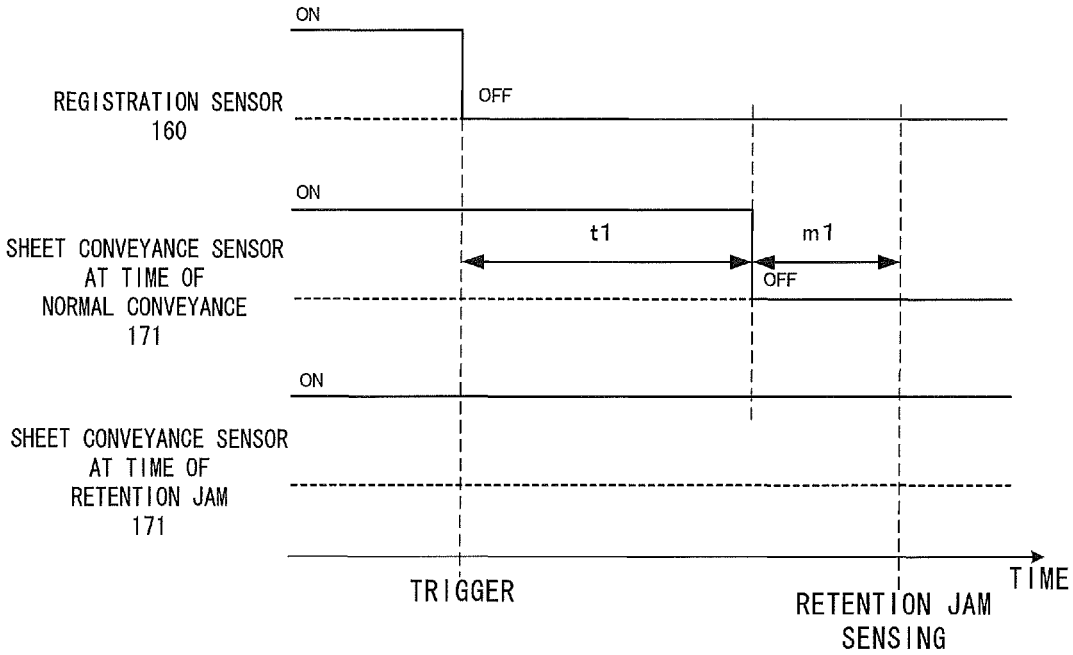
FIGS. 5A and 5B are explanatory diagrams of a jam sensing method performed by the image forming apparatus.
Figure 5B:
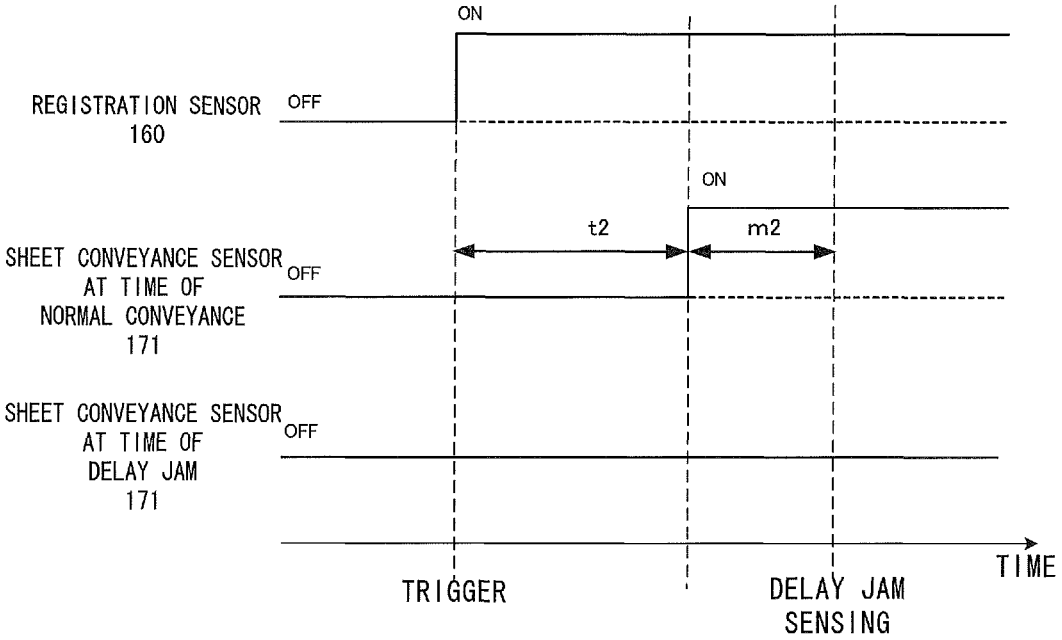

FIGS. 5A and 5B are timing charts illustrating timings of respective detection results from the registration sensor 160 and the sheet conveyance sensor 171. FIG. 5A illustrates examples of a case of normal conveyance in which the jam has not occurred and a case where the retention jam has occurred, while FIG. 5B illustrates examples of a case of the normal conveyance in which the jam has not occurred and a case where the delay jam has occurred.

Referring to FIG. 5A, retention jam sensing uses as a trigger the fact that the registration sensor 160 has sensed passage of the trailing edge of the sheet while the control portion 300 is conveying the sheet. Then, based on a distance between the registration sensor 160 and the sheet conveyance sensor 171 and a conveying speed, it is possible to calculate a required time t1 after the trailing edge of the sheet passes through the registration sensor 160 until the trailing edge passes through the sheet conveyance sensor 171. At this time, abrasion of conveying rollers may cause deterioration of conveyance efficiency. Assuming that a time provided in consideration thereof is set as a conveyance margin m1, it takes a time of t1+m1 at maximum after the trailing edge of the sheet passes through the registration sensor 160 until the trailing edge passes through the sheet conveyance sensor 171. Therefore, in a case where the sheet conveyance sensor 171 cannot sense the passage of the trailing edge of the sheet even after a lapse of the time of t1+m1, it is possible to determine that the retention jam has occurred.

Referring to FIG. 5B, delay jam sensing uses as a trigger the fact that the registration sensor 160 has sensed passage of the leading edge of the sheet while the control portion 300 is conveying the sheet. Then, based on the distance between the registration sensor 160 and the sheet conveyance sensor 171 and the conveying speed, it is possible to calculate a required time t2 after the leading edge of the sheet passes through the registration sensor 160 until the leading edge passes through the sheet conveyance sensor 171. At this time, the abrasion of conveying rollers may cause deterioration of conveyance efficiency. Assuming that a time provided in consideration thereof is set as a conveyance margin m2, it takes a time of t2+m2 at maximum after the leading edge of the sheet passes through the registration sensor 160 until the trailing edge reaches the sheet conveyance sensor 171. Therefore, in a case where the sheet conveyance sensor 171 cannot sense arrival of the leading edge of the sheet even after a lapse of the time of t2+m2, it is possible to determine that the delay jam has occurred.

Note that, jam sensing determination illustrated in FIGS. 5A and 5B is merely an example, and the present invention is not limited to the above-mentioned jam sensing method.

When the jam is thus sensed to cause the conveyance of the sheet to stop, in order to omit time and labor for the user to remove the sheet (jamming paper), the rollers involved in the sheet conveyance may be driven again for a fixed time to perform automatic sheet discharging for automatically discharging the sheet remaining within the conveying path out of the image forming apparatus.

In the case of performing the automatic sheet discharging after an occurrence of the jam, the sheet that is not buckled as illustrated in FIGS. 3A and 4A is assumed to be less likely to get snagged on the conveying path. For that reason, it can be considered that the conveyance for the automatic sheet discharging is possible.

On the other hand, with regard to the sheet having a large buckling degree as illustrated in FIGS. 3B and 4B is buckled in the leading edge of the sheet by colliding with the conveyance flapper 172 or the guide on the downstream side of the fixing device 170, and cannot be conveyed for the automatic sheet discharging. If the sheet is forced to be conveyed for the automatic sheet discharging when the buckling degree thereof is large as described above, another jam may also occur by being brought into contact with another guide on the conveying path, a flapper, a junction point, or the like.

Therefore, in this embodiment, in order to perform the automatic sheet discharging for only the sheet exhibiting small buckling as illustrated in FIGS. 3A and 4A, the control portion 300 is configured to discriminate conveyance propriety of the sheet based on the state of the sheet including the buckling degree of the sheet.

(Automatic Sheet Discharging Processing)

Figure 6A:
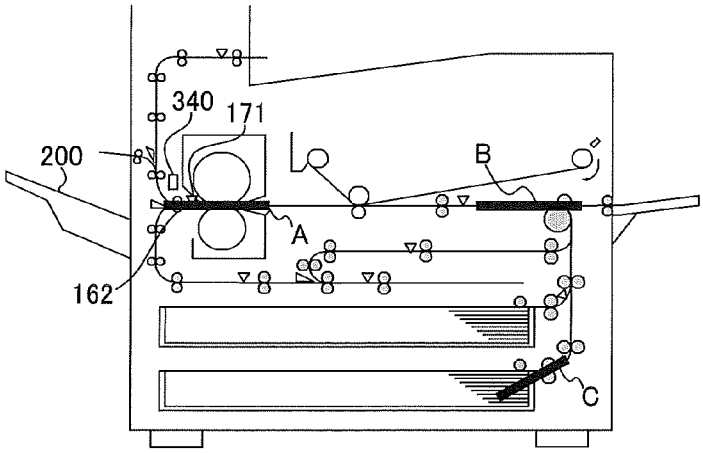
FIGS. 6A to 6C are sectional views of the image forming apparatus.
Figure 6B:
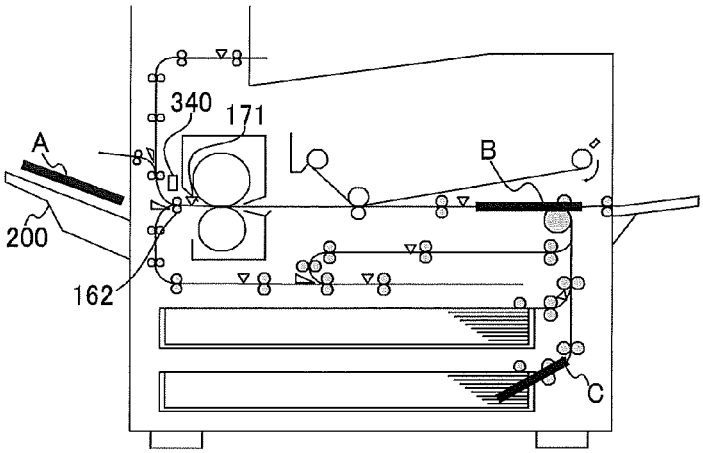
Figure 6C:
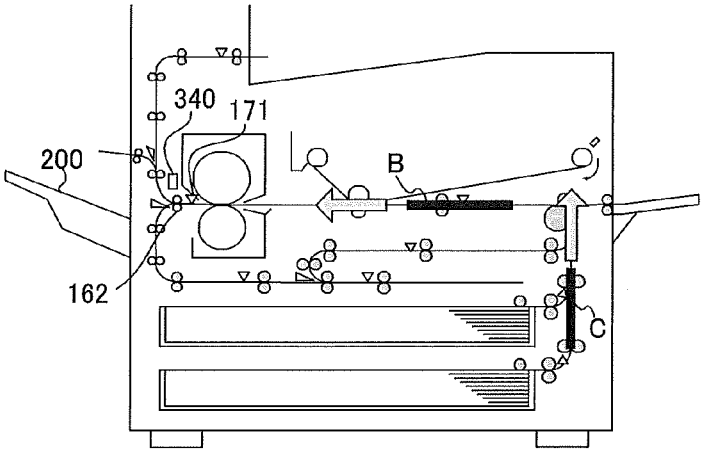

FIGS. 6A to 6C are sectional views of the image forming apparatus for illustrating a concept of automatic sheet discharging processing after the jam sensing. FIG. 6A illustrates a state in which a sheet A has stopped due to the retention jam in the conveying rollers 162 in the vicinity of the fixing device 170 and the sound collecting device 340.

If there is a sheet (not shown) on a downstream side (sheet delivery side on the conveying path) of the sheet A, the sheet is kept being conveyed to be delivered as it is without being stopped. The conveyance of sheets (sheets B and C) on an upstream side (sheet feeding side on the conveying path) is stopped. As a result, not only the sheet A but also the sheet B and the sheet C are remaining within the conveying path. At this time, the conveyance propriety of the sheet A is discriminated, and if the conveyance is possible, the sheet A is subjected to execution of the automatic sheet discharging processing to be discharged to the discharge tray 200.

FIG. 6B illustrates a state in which the automatic sheet discharging of the sheet A to the discharge tray 200 has been completed. The subsequent sheets B and C are standing by in stopped positions. FIG. 6C illustrates a state in which those sheets B and C are subjected to sheet delivery processing. Referring to FIG. 6C, the sheets B and C are conveyed toward the directions indicated by the arrows of FIG. 6C to be delivered. Note that, a delivery destination of the sheet at this time may be a tray set in advance.

Figure 7:
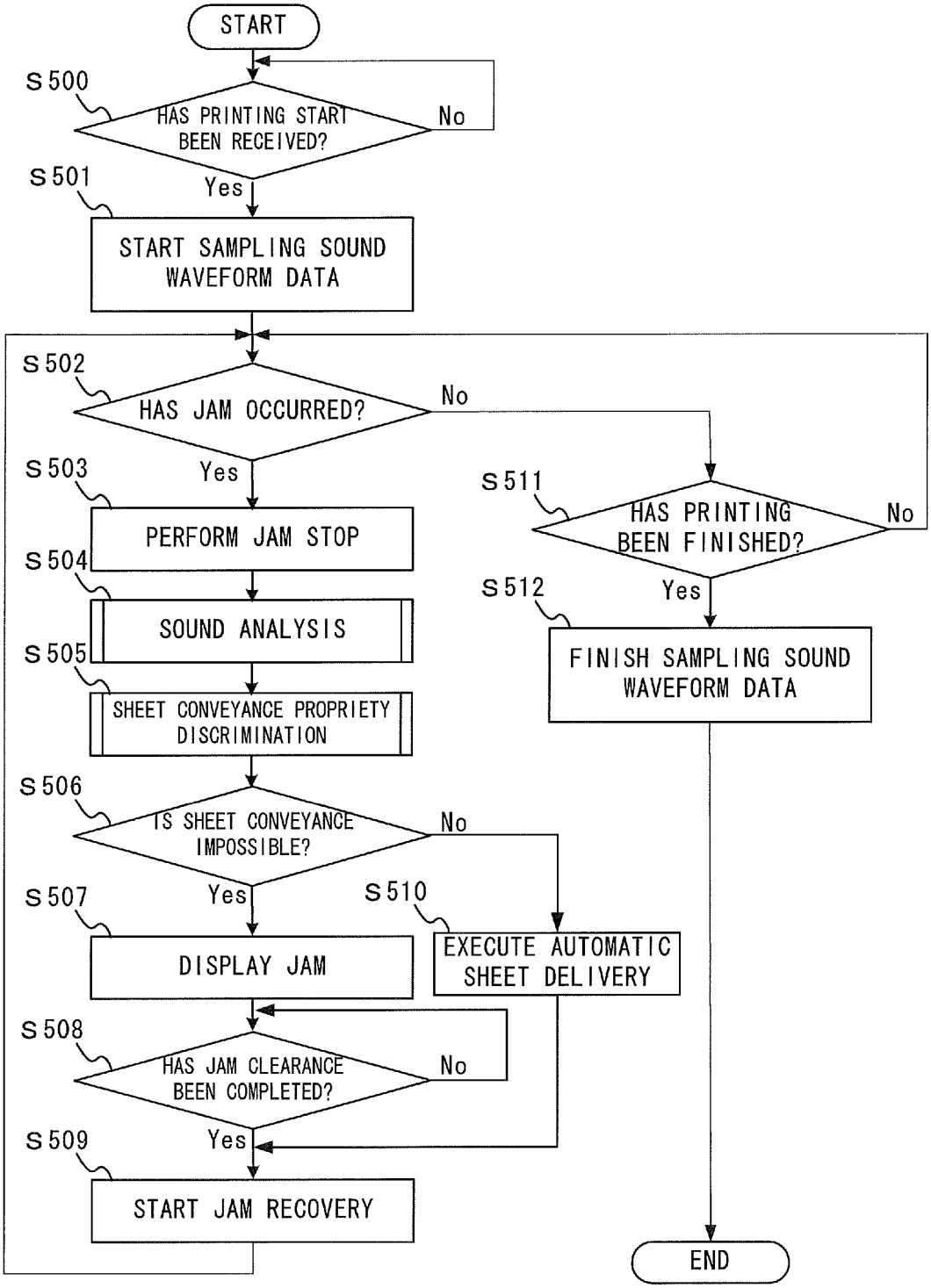
FIG. 7 is an overall flowchart of sheet conveyance processing.

FIG. 7 is an overall flowchart of sheet conveyance processing involving the above-mentioned automatic sheet discharging processing. The flowchart of FIG. 7 is executed by the CPU 301. The CPU 301 receives an input of an instruction to start printing from the UI 330 (Step S500). Subsequently, the CPU 301 starts sampling the sound data on the sheet being conveyed by using the sound collecting device 340 (Step S501). After that, the sheet conveyance for printing is started. Specifically, the CPU 301 drives the pre-fixing conveyance motor 145 and the post-fixing conveyance motor 146 via the I/O interface 310. This motor driving rotationally drives the pick-up roller 151, the registration rollers 161, the conveying rollers 153, the conveying rollers 154, the conveying rollers 155, the conveying rollers 162, and the conveying rollers 232, and the sheets are conveyed from the sheet feeding cassette 150 in order.

Further, a sampling period for the sound data is assumed to be 100μ[sec] (sampling frequency of 10 k[Hz]). Then, the CPU 301 performs the sampling 512 times, and repeats the sampling until a job is finished. The sampled data is stored in the RAM 303.

Note that, the values of the sampling frequency and the sampling number involved in the sampling of the above-mentioned sound data are merely examples, and the present invention is not limited to the above-mentioned examples.

After that, the CPU 301 uses the sheet conveyance sensor 171 or the like disposed in the vicinity of the sound collecting device 340 to sense the occurrence of the retention jam or the delay jam (Step S502). If the occurrence of the jam is not sensed (Step S502: No), the CPU 301 determines whether or not the printing has been finished (Step S511). If the printing has not been finished (Step S511: No), the procedure returns to Step S502, in which the CPU 301 continues the sensing of the jam. On the other hand, If the printing has been finished (Step S511: Yes), the CPU 301 instructs the sound collecting device 340 to finish the sampling of the sound data (Step S512).

On the other hand, if the occurrence of the jam is sensed in Step S502 (Step S502: Yes), the CPU 301 performs jam stop processing (Step S503). In the jam stop processing, the sheet conveyance on the downstream side (sheet discharged side) of the conveying rollers 162 is continued to deliver the sheet out of the image forming apparatus. Specifically, the CPU 301 continues driving the conveying rollers 162 and the conveying rollers 232 without issuing a stop instruction to the post-fixing conveyance motor 146. On the other hand, the sheet conveyance on the upstream side (sheet feeding side) of the conveying rollers 162 is stopped. Specifically, the CPU 301 issues the stop instruction to the pre-fixing conveyance motor 145. As a result, the pick-up roller 151, the registration rollers 161, the conveying rollers 153, the conveying rollers 154, the conveying rollers 155, the conveying rollers 162, and the conveying rollers 232 stop rotating. Further, the CPU 301 simultaneously causes the image forming portion 320 and the like to stop.

After that, the CPU 301 reads the sound data sampled by the sound collecting device 340 from the RAM 303 to perform sound analysis processing (Step S504). The sound analysis processing is described later.

When the sound analysis processing ends, based on a result thereof, the CPU 301 performs discrimination processing (Step S505). If it is determined in the discrimination processing that the sheet conveyance is possible (Step S506: No), the CPU 301 executes the automatic sheet discharging (Step S510). In automatic delivery, the CPU 301 issues an instruction to drive the pre-fixing conveyance motor 145 and the post-fixing conveyance motor 146 via the I/O interface 310. With this operation, the pick-up roller 151, the registration rollers 161, the conveying rollers 153, the conveying rollers 154, the conveying rollers 155, the conveying rollers 162, and the conveying rollers 232 start to rotate again. As a result, the automatic sheet discharging processing is performed as described above, for example, with reference to FIGS. 6A to 6C. In other words, the sheet of which the jam has occurred is delivered out of the image forming apparatus, and the sheets remaining on the upstream side (sheet feeding side) thereof are also delivered. Note that, the delivery destination of the sheet may be the discharge tray set in advance, or may be the discharge tray closest to a position in which the jam has occurred.

When the automatic sheet discharging processing is completed, the CPU 301 executes processing for jam recovery (Step S509). Specifically, the CPU 301 again executes the image forming processing that is supposed to be performed for the automatically-delivered sheet. The CPU 301 does not perform jam display when executing the automatic sheet discharging processing.

On the other hand, it is determined in the discrimination processing that the sheet conveyance is impossible (Step S506: Yes), the CPU 301 performs the jam display for prompting the user to remove the sheet on the upstream side (sheet feeding side) from the conveying rollers 162 (Step S507). After that, the CPU 301 waits until the user completes jam clearance such as removal of the sheet according to the jam display (Step S508). When the jam clearance is completed by the user (Step S508: Yes), the CPU 301 starts the jam recovery (Step S509).

Note that, in the jam stop processing of Step S503, the image forming operation performed by the image forming portion 320 and other such operation are stopped, but the sheet conveyance may be stopped after the sound analysis processing of Step S504 or the discrimination processing of Step S505. In that case, if it is determined in the discrimination processing that the sheet conveyance is possible, the jam can be handled without stopping the conveying rollers.

(Sound Analysis Processing)

Figure 8:
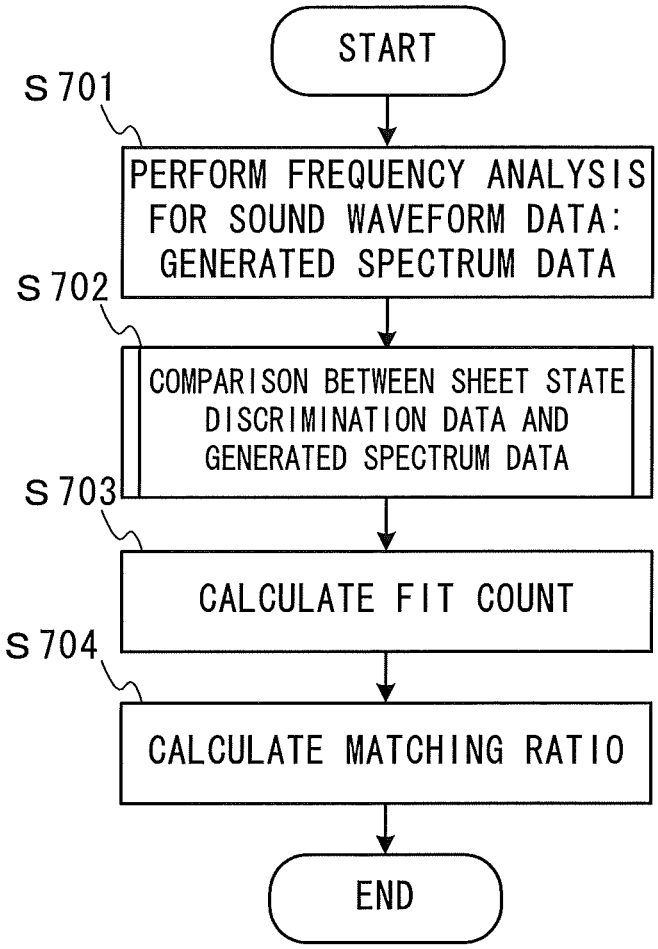
FIG. 8 is a flowchart of sound analysis processing.

A procedure for the sound analysis processing of Step S504 (FIG. 7) described above is now described. FIG. 8 is a flowchart of the sound analysis processing.

During the conveyance of the sheet, sound is generated even in the normal conveyance, but in a special state such as a state in which the sheet is slipped or buckled, sound having a characteristic frequency component, which is different from that at a time of the normal conveyance, is generated. In this embodiment, such sound (sound data) is collected by the sound collecting device 340 to be used for discrimination of the conveyance propriety of the sheet in the sound analysis processing.

The CPU 301 performs frequency analysis for the sound data collected by the sound collecting device 340 and saved in the RAM 303 (Step S701). The frequency analysis is performed by, for example, transforming the sound data into intensity (dB) of each frequency component by a fast Fourier transform (FFT). With this operation, a frequency spectrum ranging from a low frequency to a high frequency is obtained. The frequency spectrum is expressed by assuming, for example, the frequency as the horizontal axis and the intensity of each frequency component as the vertical axis. In this embodiment, the frequency spectrum is referred to as "generated spectrum data".

Subsequently, the CPU 301 compares the generated spectrum data with the reference spectrum data read from the ROM 302 (Step S702). The reference spectrum data is described later in detail. Further, the CPU 301 calculates a fit count based on the comparison result (Step S703), and further calculates a matching ratio (Step S704).

The matching ratio (%) is calculated by, for example, the following expression.

$$(\text{matching ratio})=(\text{fit count})\div(\text{data count})\times 100$$

The results of the calculation are stored in the RAM 303, and the sound analysis processing is brought to an end.

Note that, the fast Fourier transform is merely an example of a method for the frequency analysis, and the present invention is not limited to this method. For example, an auto-regression-type maximum entropy method (MEM) may be employed. Further, an auto-regressive (AR) model, an auto-regressive moving average (ARMA) model, or the like may be used.

Further, the sound analysis processing may be executed by the sound collecting device 340 instead of the control portion 300. In this case, a result of the sound analysis processing is transmitted to the control portion 300.

(Discrimination Processing)

Figure 9:
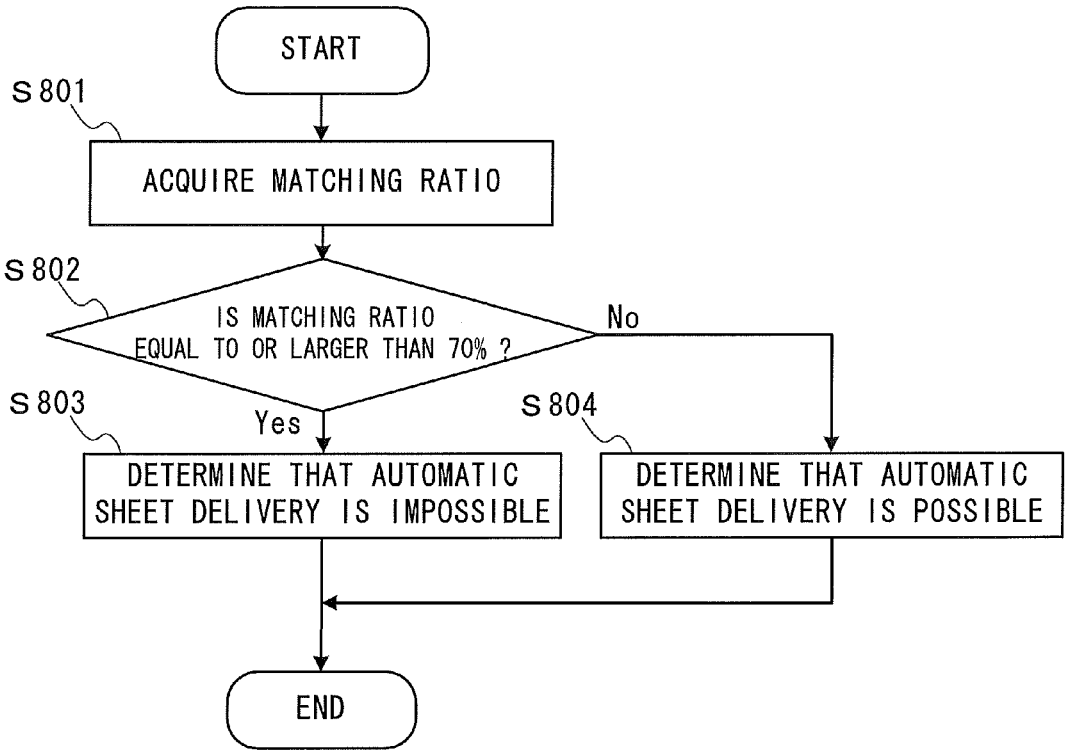
FIG. 9 is a flowchart of discrimination processing.

Next, a procedure for the discrimination processing of Step S505 (FIG. 7) for discriminating whether or not the sheet conveyance is possible is described. FIG. 9 is a flowchart of the discrimination processing.

In the discrimination processing, first, the CPU 301 acquires the matching ratio calculated in Step S704 (FIG. 8) of the sound analysis processing from the RAM 303 (Step S801). Subsequently, the CPU 301 determines whether or not the matching ratio is equal to or larger than 70% (Step S802). If the matching ratio is equal to or larger than 70% (Step S802: Yes), the CPU 301 recognizes that the sheet exhibits the buckling and determines that the automatic sheet discharging is impossible (Step S803). On the other hand, if the matching ratio is less than 70% (Step S802: No), the CPU 301 recognizes that the sheet does not exhibit the buckling and determines that the automatic sheet discharging is possible (Step S804). After that, the CPU 301 stores discrimination results in the RAM 303, and ends the processing.

(Data Comparison Processing)

Figure 10:
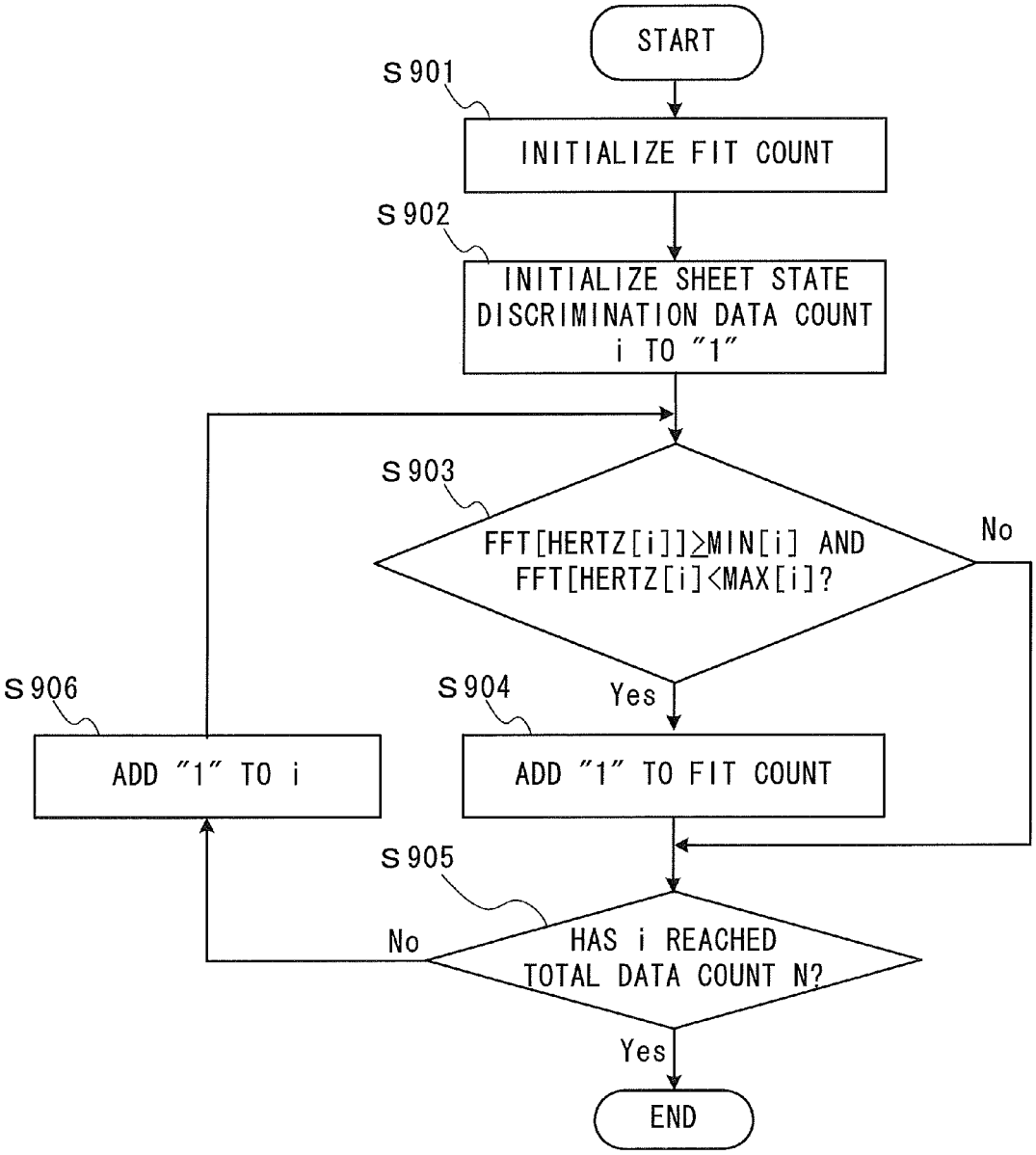
FIG. 10 is a flowchart of data comparison processing.

Next, referring to FIG. 10, data comparison processing between the reference spectrum data and the generated spectrum data, which is performed in Step S702 (FIG. 8) of the sound analysis processing, is described in detail. FIG. 10 is a flowchart of the data comparison processing.

The CPU 301 first initializes the fit count to 0 (Step S901), and then initializes a variable i, which is used to count the number of pieces of reference spectrum data, to 1 (Step S902).

The CPU 301 reads an upper limit value (MAX[i]) and a lower limit value (MIN[i]) of the intensity of the frequency component within the frequency of the reference spectrum data. Then, the CPU 301 compares the intensity of the frequency component (FFT[HERTZ[i]]) of the generated spectrum data corresponding to the above-mentioned frequency (HERTZ[i]) with the read data (Step S903).

When the intensity of the frequency component (FFT [HERTZ[i]]) falls within a range defined by the upper limit value (MAX[i]) and the lower limit value (MIN[i]) of the intensity of the frequency component within the reference spectrum data (Step S903: Yes), the CPU 301 adds "1" to the fit count (Step S904). On the other hand, if the intensity is out of the range (Step S903: No), the fit count is not subjected to addition.

After that, if a data count i reaches a total data count N of the reference spectrum data (Step S905: Yes), the CPU 301 ends the comparison processing. If the data count i has not reached the total data count N (Step S905: No), the CPU 301 adds "1" to the data count (Step S906), and the procedure advances to Step S903. The CPU 301 calculates the fit count by performing the above-mentioned comparison processing the same number of times as the total data count N of the reference spectrum data.

Figure 12:
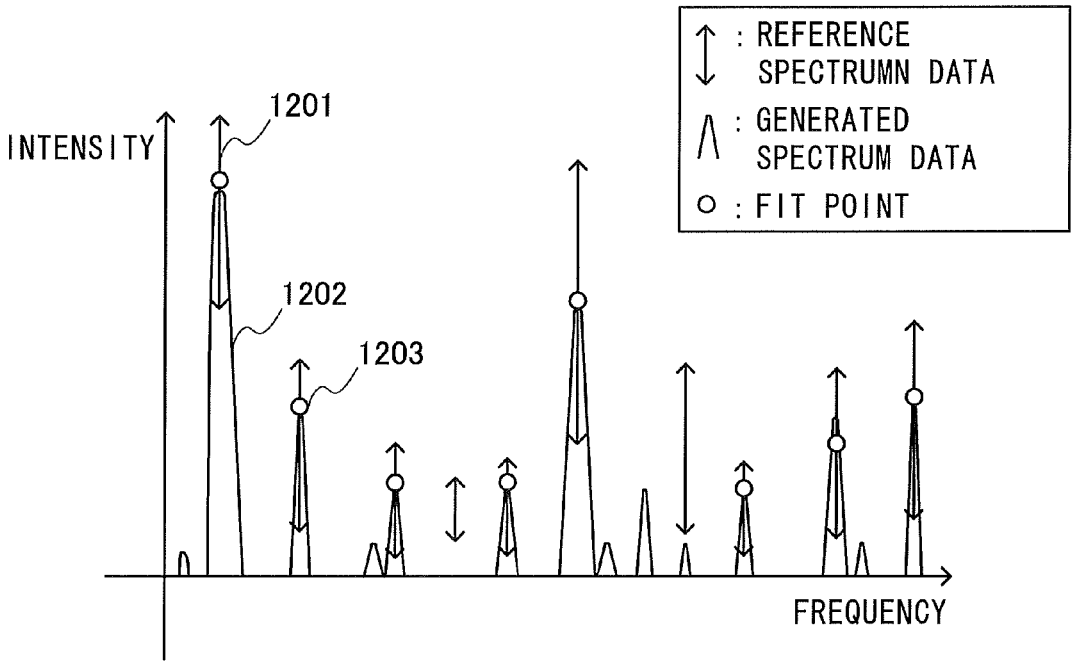
FIG. 12 is a conceptual diagram illustrating a comparison between the generated spectrum data and the reference spectrum data.
Figure 14:
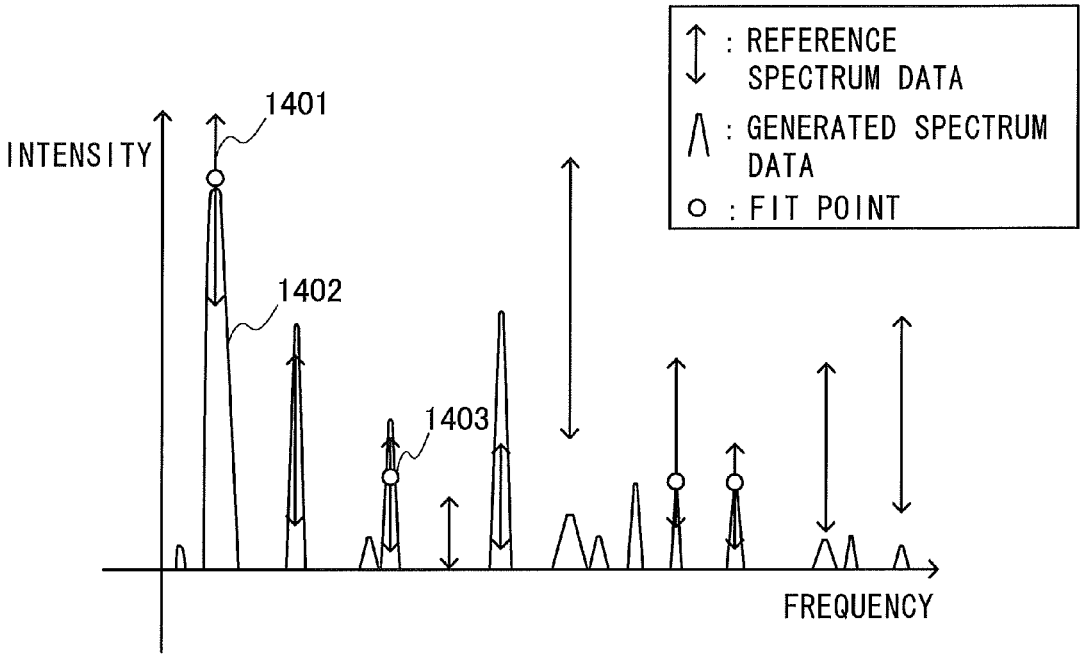
FIG. 14 is a conceptual diagram illustrating the comparison between the generated spectrum data and the reference spectrum data.

Next, referring to FIGS. 11A to 14, specific examples of the data comparison processing are described. FIGS. 11A and 13A illustrate the generated spectrum data, FIGS. 11B and 13B illustrate the reference spectrum data, and FIGS. 11C and 13C illustrate comparison results between the generated spectrum data and the reference spectrum data. Further, FIGS. 12 and 14 are conceptual diagrams illustrating the comparison processing between the generated spectrum data and the reference spectrum data.

In the example of FIG. 11B, the data count N of the reference spectrum data is 10 points (frequencies A to J). A comparison is performed in terms of a frequency of 400 [Hz]. In a reference spectrum, the intensity of a frequency A component (A=400 [Hz]) has a lower limit value of 60 [dB] and an upper limit value of 100 [dB]. In this case, the intensity of the frequency 400 [Hz] within the generated spectrum data is 88 [dB], and hence the intensity (88 [dB]) of the frequency component falls between the lower limit value (60 [dB]) and the upper limit value (100 [dB]) within the reference spectrum data. In the same manner, the comparison processing is performed the same number of times as the data count (N is 10 points of A to J) of the reference spectrum data. With this operation, as illustrated in FIG. 11C, the fit count is 8, and the matching ratio is 80%. The fit count and the matching ratio are saved in the RAM 303.

On the other hand, in the example of FIG. 13B, a case where the reference spectrum data has a frequency of 4,700 [Hz] (J: 4,700 [Hz]) is observed. In that case, the intensity (5 [dB]) of the frequency component within the generated spectrum data does not fall between the lower limit value (15 [dB]) and the upper limit value (60 [dB]) within the reference spectrum data. This means that the above-mentioned frequency J does not fit, and Step S903 described above results in "No". In this manner, after the processing is performed the same number of times as the total data count (N is 10 points of A to J), as in FIG. 13C, the fit count and the matching ratio are finally calculated as 4 and 40%, respectively.

Referring to FIGS. 12 and 14, conceptual diagrams illustrating comparisons between the generated spectrum data and the reference spectrum data are described. In those conceptual diagrams, the horizontal axis indicates the frequency, and the vertical axis indicates the intensity. Reference spectrum data pieces 1201 and 1401 are each expressed as a variation range of the intensity limited by the lower limit value and the upper limit value. The generated spectrum data pieces 1202 and 1402 are each expressed by quantification data having an intensity corresponding to the frequency. Fit points 1203 and 1403 indicate that the intensity of the frequency component within the generated spectrum data is included in the variation range of the frequency. The numbers of fit points 1203 and 1403 that appear in FIGS. 12 and 14, respectively, are the fit counts. The reference spectrum data is decided by an experiment, and is previously stored in the ROM 302.

Next, a method of generating the reference spectrum data is described.

The reference spectrum data is used for determination as to whether or not the sheet is buckled. FIGS. 11B and 13B are examples of the reference spectrum data. The reference spectrum data has arbitrary numbers of frequencies 1103 and 1303 within the frequency spectrum and intensities 1104 and 1105 and intensities 1304 and 1305 of the corresponding frequency components, respectively, as characteristic frequency spectra obtained when the sheet is buckled.

In order to generate the reference spectrum data, the image forming apparatus is set to an adjustment mode, and the sheet is conveyed. The CPU 301 controls the image forming apparatus so as to intentionally cause the sheet to collide with the conveyance flapper 172 during the sheet conveyance. The CPU 301 acquires the sound data generated when the sheet is buckled from the sound collecting device 340 at that time, and performs the frequency analysis. In consideration of variations in the sound data, the sampling of the above-mentioned sound data is attempted 30 times. The CPU 301 performs the frequency analysis for the respective pieces of sound data corresponding to the 30 times, and extracts the numbers of times of appearance of the respective frequencies within the calculated frequency spectrum. The CPU 301 decides the frequency that appears 20 times or more often thereamong as the characteristic frequency.

Subsequently, in order to extract characteristics of the intensity of the frequency component, the CPU 301 generates a histogram of the intensity of each frequency within the frequency spectrum in the sampling of the above-mentioned sound data corresponding to the 30 times.

There are variations in the intensities of the frequency components within the respective frequencies, and hence the CPU 301 calculates maximum values (upper limit values) 1104 and 1304 and minimum values (lower limit values) 1105 and 1305 of the intensities of the frequency components, and sets the resultant as the characteristics of the intensity of the frequency component.

A combination of the frequency within the frequency spectrum and the intensity of the frequency component is to be used as the reference spectrum data obtained when paper is buckled.

Note that, the number of times that the sampling of the sound data is attempted when the above-mentioned reference spectrum data is generated is merely an example, and the present invention is not limited thereto. Further, a measurer may use a measurement apparatus separately from the CPU 301 to generate the reference spectrum data.

As described above, according to this embodiment, by analyzing the sound generated from the sheet at the occurrence of the jam, it is possible to discriminate presence/absence of the buckling of the sheet, and it is possible to effectively determine whether or not the automatic sheet discharging is possible. Accordingly, it is possible to increase the frequency of executing the automatic sheet discharging, to thereby lighten the load on the user performing work of manually removing the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-106893, filed May 8, 2012, which is hereby incorporated by reference herein in its entirety.

What is claimed is:

1. An image forming apparatus, comprising:

a conveyance unit configured to convey a sheet along a conveying path;

a microphone configured to collect sound generated by performing, by the conveyance unit, conveyance of the sheet;

a sheet detecting unit configured to detect the sheet;

a jam detecting unit configured to detect a jam of the sheet;

a control unit configured to control to stop conveying the sheet by the conveyance unit if the jam of the sheet is detected by the jam detecting unit;

an analysis unit configured to analyze a frequency of the sound during a period in which the sheet is being conveyed if the jam of the sheet is detected by the jam detecting unit; and a decision unit configured to determine whether or not an intensity of a frequency component falls within a predetermined range, that is corresponding to the frequency, for each frequency based on the analyzed frequency and decide whether or not the conveyance unit is enabled to discharge the sheet based on a number of frequencies whose intensity of the frequency component falls within the predetermined range;

wherein the control unit causes, based on the analyzed frequency, in a case where a number of frequencies whose intensity of the frequency component falls within the predetermined range is smaller than a predetermined number, the conveyance unit to stop conveying the sheet and then discharge the sheet.

2. The image forming apparatus according to claim 1, further comprising an informing unit configured to inform of the jam of the sheet after the control unit causes, based on the analyzed frequency, in a case where a number of frequencies whose intensity of the frequency component falls within the predetermined range is equal to or larger than a predetermined number, the conveyance unit to stop conveying the sheet.

3. The image forming apparatus according to claim 1, wherein:

the predetermined range comprises a range between a first value and a second value smaller than the first value;

the first value corresponds to a first frequency component; and the second value corresponds to a second frequency component.

4. The image forming apparatus according to claim 1, further comprising a fixing unit configured to fix an image to the sheet by using heat, wherein the microphone is provided on a downstream side of the fixing unit in a direction in which the sheet is conveyed.

5. The image forming apparatus according to claim 1, wherein:

the jam detecting unit detects the jam of the sheet when the sheet fails to be detected by the sheet detecting unit at a prescribed timing.

6. The image forming apparatus according to claim 5, wherein the jam detecting unit detects the jam of the sheet when a leading edge of the sheet in a direction in which the sheet is conveyed fails to be detected by the sheet detecting unit at the prescribed timing.

7. The image forming apparatus according to claim 5, wherein the jam detecting unit detects the jam of the sheet when a trailing edge of the sheet in a direction in which the sheet is conveyed fails to be detected by the sheet detecting unit at another prescribed timing.

8. The image forming apparatus according to claim 5, wherein:

the sheet detecting unit comprises:

a first sheet detecting portion configured to detect the sheet in a first position; and a second sheet detecting portion configured to detect the sheet in a second position;

the second position is located on a downstream side of the first position in a direction in which the sheet is conveyed; and the jam detecting unit detects the jam of the sheet when the sheet fails to be detected by the second sheet detecting portion even after a lapse of a predetermined time since a leading edge of the sheet in the direction in which the sheet is conveyed is detected by the first sheet detecting portion.

9. The image forming apparatus according to claim 5, wherein:

the sheet detecting unit comprises:

a first sheet detecting portion configured to detect the sheet in a first position; and a second sheet detecting portion configured to detect the sheet in a second position;

the second position is located on a downstream side of the first position in a direction in which the sheet is conveyed; and the jam detecting unit detects the jam of the sheet when the sheet is detected by the second sheet detecting portion even after a lapse of another predetermined time since a trailing edge of the sheet in the direction in which the sheet is conveyed is detected by the first sheet detecting portion.

* * * * *